US007651334B2

(12) United States Patent
Zhang

(10) Patent No.: US 7,651,334 B2
(45) Date of Patent: Jan. 26, 2010

(54) COAXIAL ELECTRICAL CONNECTOR

(75) Inventor: George(Huanyi) Zhang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 11 days.

(21) Appl. No.: 11/982,635

(22) Filed: Nov. 2, 2007

(65) Prior Publication Data

US 2009/0117779 A1 May 7, 2009

(51) Int. Cl.
*H01R 12/00* (2006.01)

(52) U.S. Cl. ..... 439/63; 439/581

(58) Field of Classification Search ..... 439/63, 439/581, 83

See application file for complete search history.

(56) References Cited

U.S. PATENT DOCUMENTS 5,046,952 A * 9/1991 Cohen et al. ..... 439/63
6,074,217 A * 6/2000 Maruyama et al. ..... 439/581
6,264,475 B1 * 7/2001 Machado ..... 439/63
6,474,995 B1 * 11/2002 Wu ..... 439/63
6,648,653 B2 * 11/2003 Huang et al. ..... 439/582
6,902,408 B2 6/2005 Yamane
6,942,500 B2 * 9/2005 Chen ..... 439/83
7,008,235 B2 * 3/2006 Watanabe ..... 439/581
2001/0027033 A1 * 10/2001 Fujimoto et al. ..... 439/63
2006/0046547 A1 * 3/2006 Matsuo ..... 439/188

* cited by examiner

*Primary Examiner*—Briggitte R Hammond
(74) *Attorney, Agent, or Firm*—Wei Te Chung; Andrew C. Cheng; Ming Chieh Chang

(57) ABSTRACT

A coaxial electrical connector to be connected to a printed circuit board, includes an outer conductor (10), a central conductor (20) having an axial contact section (21), and a dielectric block (30) molded to hold the outer and central conductors together. A radial section (22) extends outwardly from a bottom of the contact section. A lower surface of the radial section is concaved with respect to the printed circuit board such that there has no material other than air under the lower surface of the radial section, thereby adjust the impedance of contact to a proper value by changing the dielectric constant under the lower surface of the radial section.

5 Claims, 6 Drawing Sheets

COAXIAL ELECTRICAL CONNECTOR

BACKGROUND OF THE INVENTION

1. Field of the Invention

The present invention relates to the art of electrical connectors, and more particularly to a coaxial electrical connector for being connected to a printed circuit board.

2. Description of the Related Art

Impedance match issue is one of the most important things for signal transmission of electrical connectors. Different kinds of ways are adopted by designers to adjust the impedance of contacts to a proper value. In order to adjust the impedance of contacts to a proper value, designers usually adopt the way of changing the dielectric constant around the contacts. As disclosed in U.S. Pat. No. 6,902,408, a coaxial electrical connector includes an outer conductor having a tubular section, a central conductor having a contact section that extends in an axial direction within the tubular section, a dielectric block molded so as to hold together the outer and central conductors as a unit, and a radial section extending outwardly from a bottom of the contact section. There has a part of the dielectric block attached around a bottom surface of the radial section, which may influence the impedance of contacts due to having the dielectric material disposed around the radial section. Due to high speed data rate was arisen, the above design of the coaxial electrical connector could not meet the electrical performance requirement because of the impedance of the contact (i.e. around the contact section). Thus, it is supposed to adjust the impedance of the contact by changing the dielectric constant around the contact.

Therefore, there is a need to provide a coaxial electrical connector to resolve the above-mentioned problem.

SUMMARY OF THE INVENTION

A coaxial electrical connector, to be connected to a printed circuit board, according to an embodiment of the present invention includes an outer conductor having a tubular section, a central conductor having a contact section that extends in an axial direction within the tubular section, and a dielectric block molded so as to hold together the outer and central conductors as a unit. A radial section extends outwardly from a bottom of the contact section. An extension section extends from the radial section in a radial direction at a connection point, with a lower face of said extension section adapted to be in contact with the printed circuit board. A lower surface of the radial section is raised with respect to the lower face of the extension section such that there has no material other than air under the lower surface of the radial section. Thus, as compared with the prior art of having a dielectric material located under the lower surface of the radial section, that room defined by the lower surface of the extension section and the printed circuit board to be full of air will adjust the impedance of contact (i.e. the contact section) to a proper value because of the lowest dielectric constant of air located below the lower surface of the radial section.

Other features and advantages of the present invention will become more apparent to those skilled in the art upon examination of the following drawings and detailed description of preferred embodiments, in which:

DETAILED DESCRIPTION OF PREFERRED EMBODIMENT

Referring to FIGS. 1 to 6, an electrical connector assembly according to an embodiment of the present invention is shown to include a printed circuit board 1, and a coaxial electrical connector to be electrically connected onto the printed circuit board 1. The coaxial electrical connector includes an outer conductor 10, a central conductor 20 and a dielectric block 30 that integrally holds the outer conductor 10 and the central conductor 20 as a unit.

Figure 5:
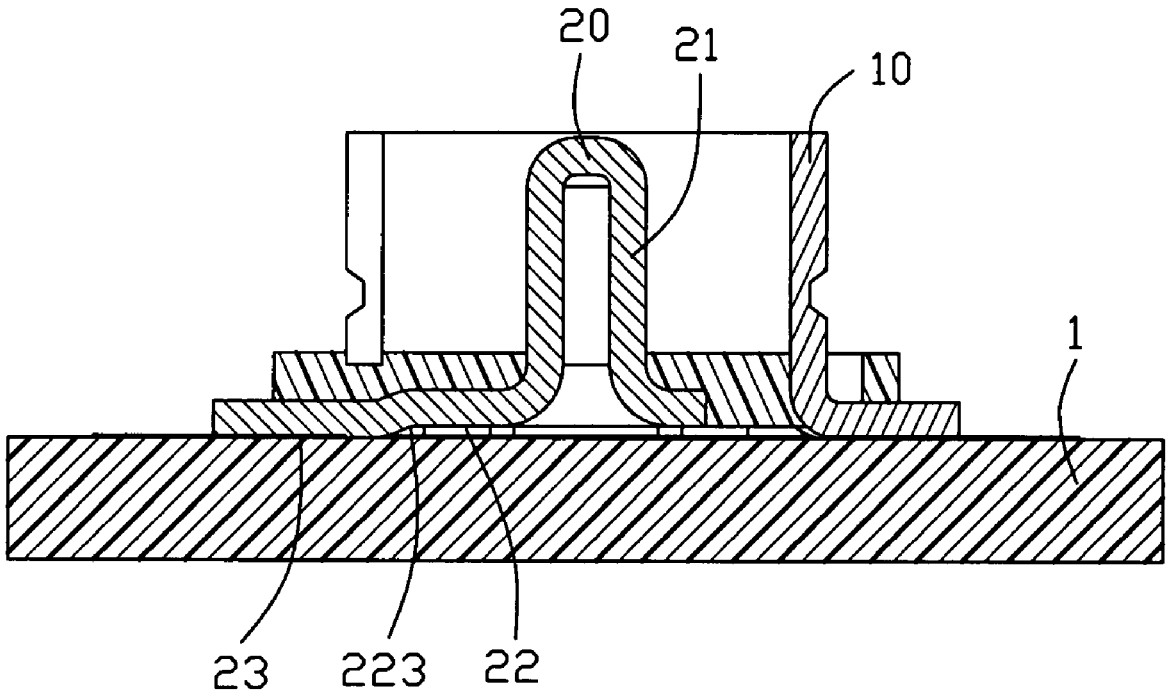
FIG. 5 is a cross-sectional view of the electrical connector assembly of FIG. 1 taken along line 5-5 thereof.

The outer conductor 10 is made by bending and forming a metal sheet so as to provide a tubular section 11 having an axial line in a plugging direction with a mating connector (not shown) and three leg sections 12 extending outwardly from a bottom of the tubular section 11. The tubular section 11 is provided with an engaging groove 13 for engagement with the outer conductor of a mating connector (not shown) for preventing separation. A pair of leg sections 12A and 12B, which are diametrically opposed to each other, are made relatively wide and the other leg section 12C is narrower than these two leg sections. As shown in FIG. 5, the leg sections 12A and 12B are flush with a bottom face of the connector so that when the connector is placed on the printed circuit board 1, they are soldered with circuit traces (not shown) of the printed circuit board 1. The leg sections 12A and 12B each has a curved border so as to have a more stronger solder connection with the circuit traces of the printed circuit board 1 due to having the longer outer line of the curved border as opposed to the linear-type border of the conventional leg section. Each of the leg sections 12A and 12B is designed to have two solder wings 121 with a groove 122 therebetween. The arrangement of the groove 122 between the two solder wings 121 will enable the additional solder material to be gathered within the groove 122 of each leg section 12A or 12B so as to prevent the overflow, during the soldering process, of the additional solder material out of the region of each leg section 12A or 12B, which may affect the effective solder connection between the leg sections 12A and 12B and the circuit traces of the printed circuit board 1.

Figure 1:
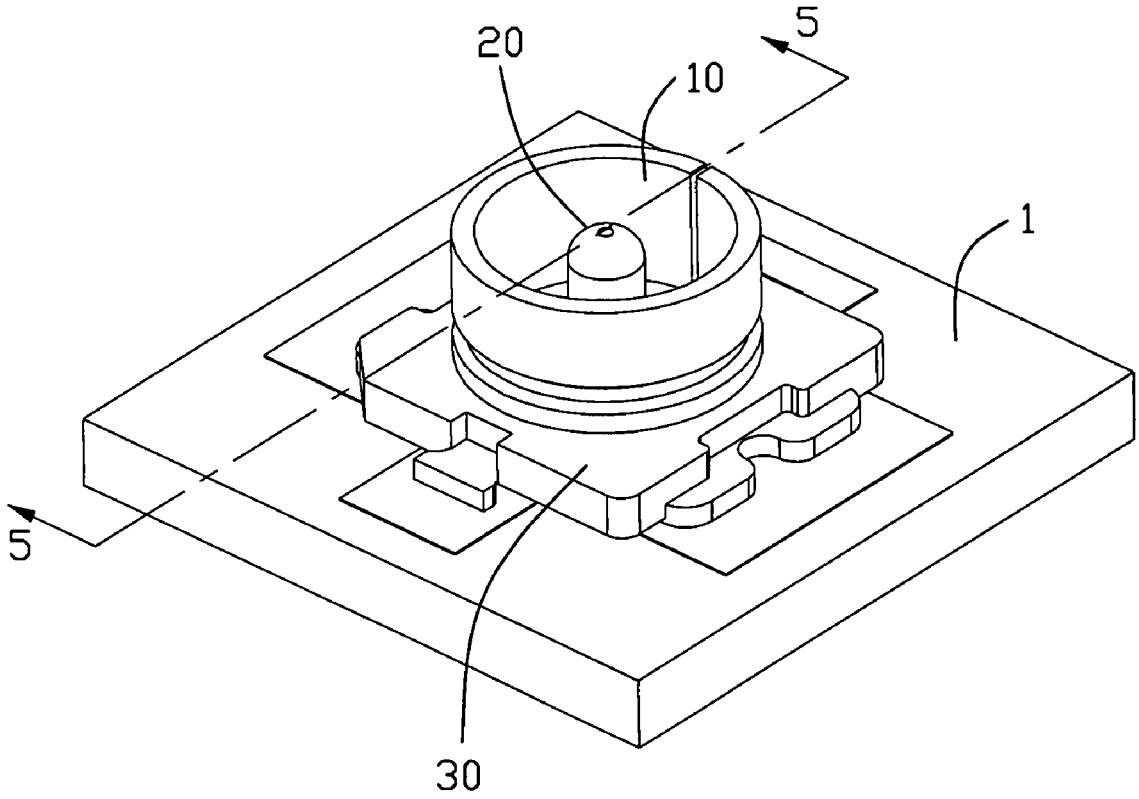
FIG. 1 is an assembled, perspective view of an electrical connector assembly including thereof a coaxial electrical connector and a printed circuit board according to an embodiment of the present invention.
Figure 2:
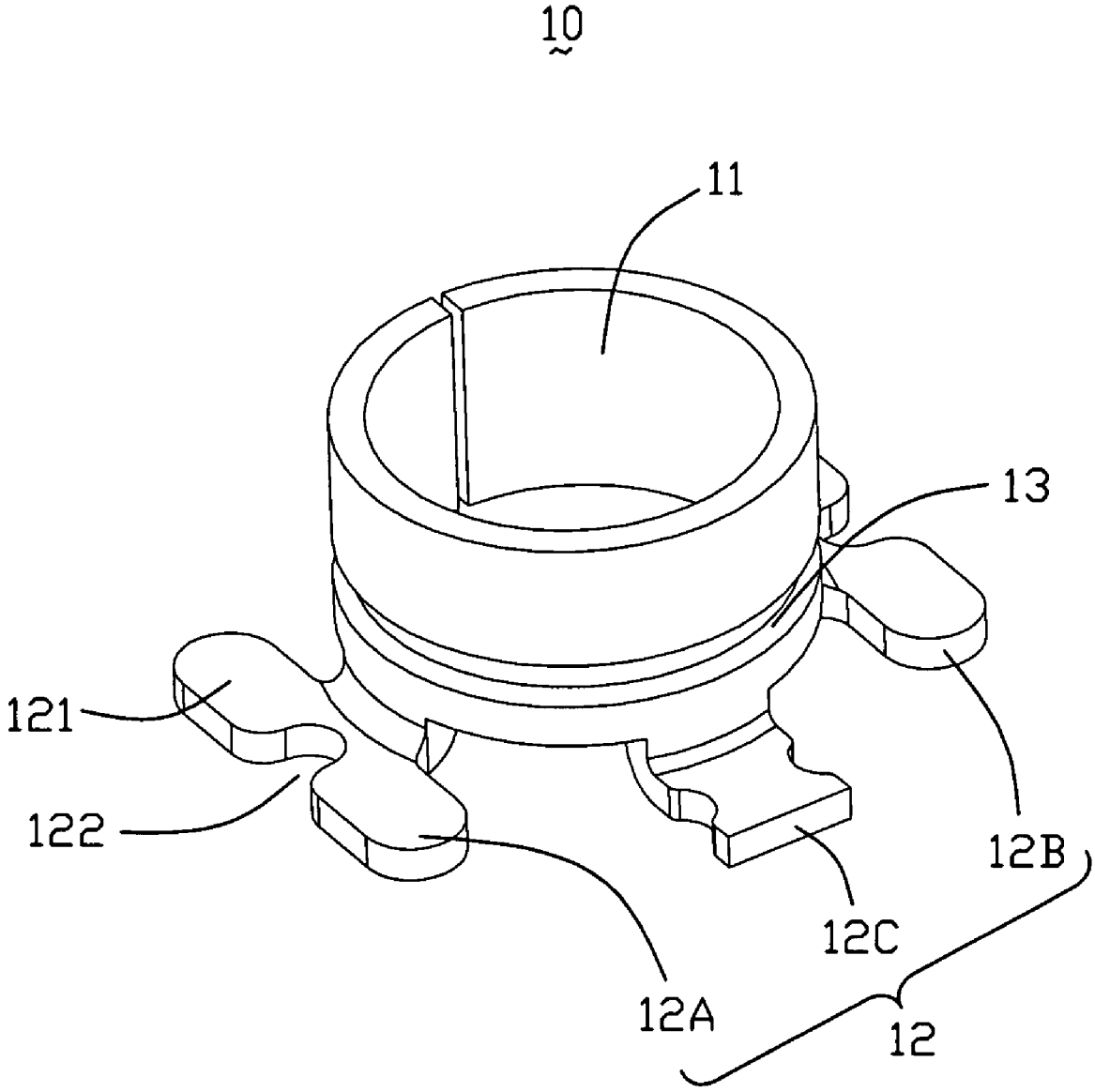
FIG. 2 is a perspective view of an outer conductor included within the coaxial electrical connector of FIG. 1.
Figure 3:
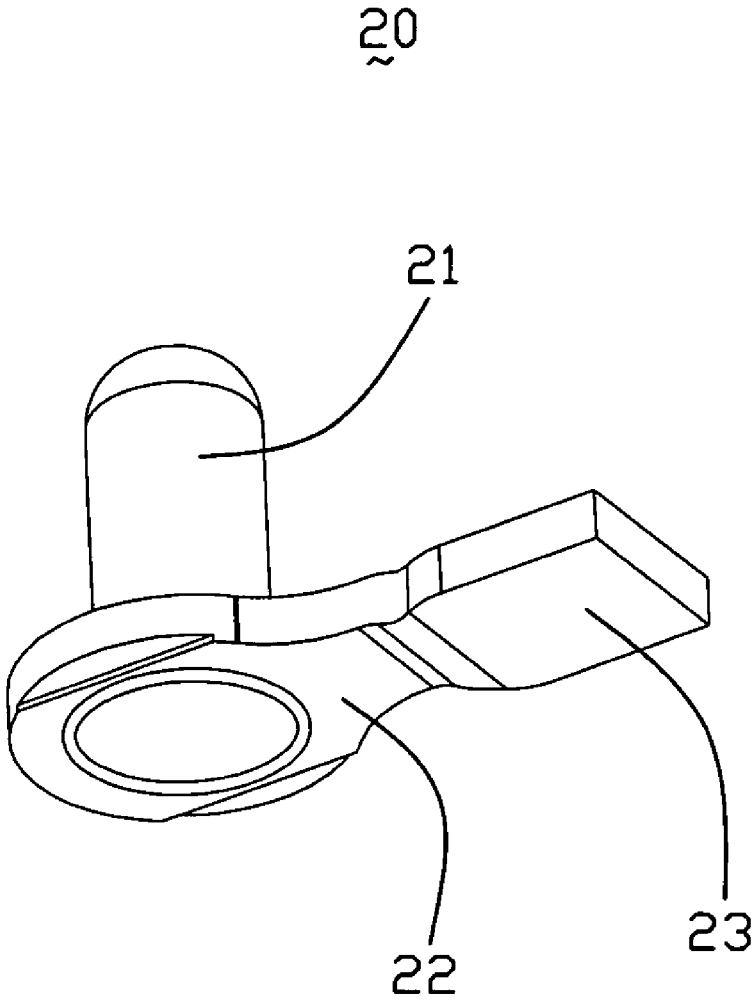
FIG. 3 is a perspective view of a central conductor included within the coaxial electrical connector of FIG. 1.
Figure 4:
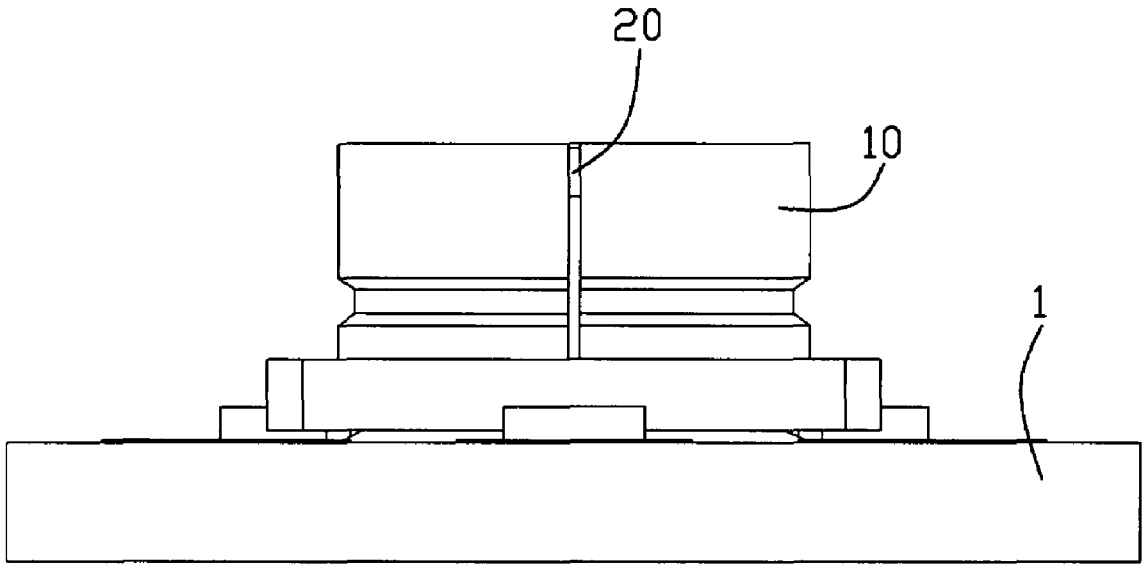
FIG. 4 is a front view of the coaxial electrical connector of FIG. 1.

As shown in FIG. 3, the central conductor 20 is made by bending and forming a metal sheet so as to provide a contact section 21 that extends in an axial direction within the tubular section, and a radial section 22 that extends outwardly in a radial direction from a bottom of the contact section 21. The contact section 21 is made by deep-drawing pressing a metal sheet so as to provide a hollow form having a semi-spherical tip and flared bottom that leads to the radial section 22. An extension section 23 extends in the radial direction from a connection point 223 as shown in the cross-section view of FIG. 5. The lower face of the extension section 23 is adapted to be in contact with the printed circuit board 1. It should be noted that the tip of the central conductor 20 of this preferred embodiment, as particularly shown in FIG. 4, does not exceed the top of the outer conductor 10. However, in an alternative embodiment, the tip of the central conductor 20 may be located beyond the top of the outer conductor 10 depending on different applications of a coaxial electrical connector.

Figure 6:
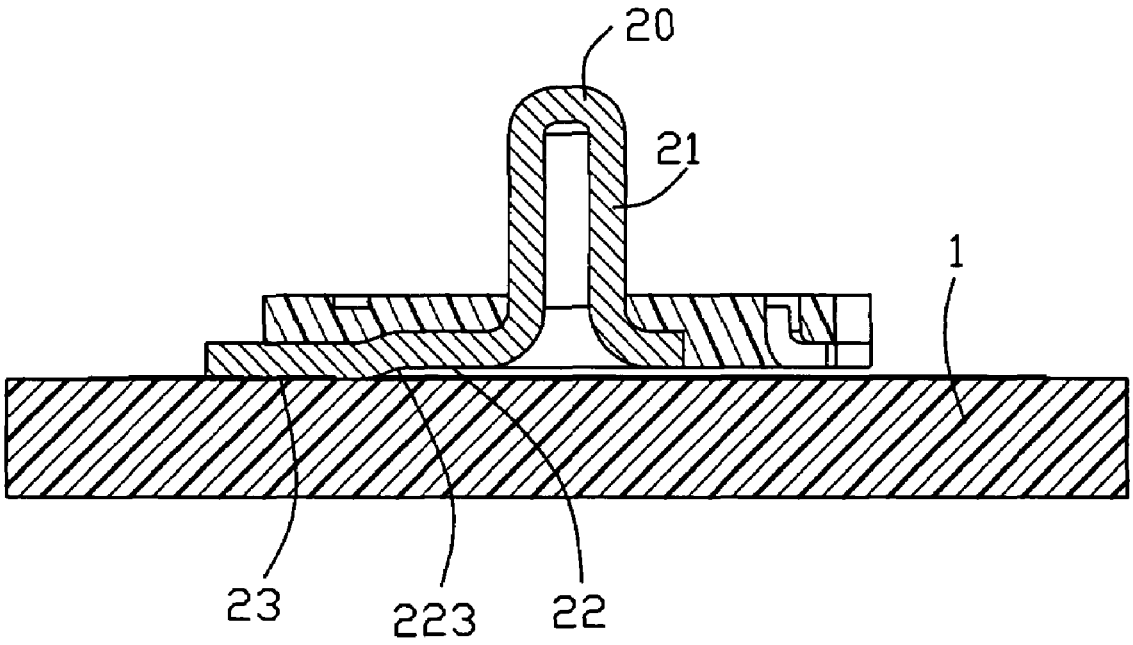
FIG. 6 is a cross-sectional view of the electrical connector assembly of FIG. 5 but with the outer conductor removed therefrom.

As shown in FIGS. 3 and 6, a lower surface of the radial section 22 is raised with respect to the lower surface of the extension section 23 such that there has no material, especially the dielectric material, other than air under the lower surface of the radial section 22. That is, after the coaxial electrical connector is assembled onto the printed circuit board 1, the lower surface of the radial section 22 is spaced away from the printed circuit board 1 such that there has no material other than air between the lower surface of the radial section 22 and the printed circuit board 1. In this preferred embodiment, the radial section 22 has a concaved lower surface so as to have more surface to contact air. In order to exhibit the state under the lower surface of the radial section 22, FIG. 5 shows a cross-sectional view of the electrical connector assembly of FIG. 1 taken along line 5-5 thereof, while FIG. 6 shows a corresponding cross-sectional view of the same electrical connector assembly but with the outer conductor 10 removed therefrom so as to clearly represent there has no material other than air between the lower surface of the radial section 22 and the printed circuit board 1. Thus, as compared with the prior art of having a dielectric material located under the lower surface of the radial section 22, that room defined by the lower surface of the radial section 22 and the printed circuit board 1 to be full of air will adjust the impedance of contact (i.e. the contact section 21) to a proper value because of the lowest dielectric constant of air located below the lower surface of the radial section 22. Thus, by changing the dielectric constant around the contact, the above design of the coaxial electrical connector will have an improved electrical performance to meet the arisen speed date rata as required by the current electrical connector.

While the present invention has been described with reference to preferred embodiments, the description of the invention is illustrative and is not to be construed as limiting the invention. Various modifications to the present invention can be made to preferred embodiments by those skilled in the art without departing from the true spirit and scope of the invention as defined by the appended claims.

What is claimed is:

1. An electrical connector assembly comprising:

a printed circuit board;

a coaxial electrical connector to be connected to the printed circuit board, the coaxial electrical connector comprising:

an outer conductor having a tubular section;

a central conductor having a contact section that extends along an axial direction within said tubular section;

a dielectric block integrally molded with at least the central conductor as a unit and further assembled with the outer conductor;

a radial section extending outwardly from a bottom of said contact section;

an extension section extending from said radial section in a radial direction at a connection point, a lower face of said extension section adapted to be in contact with said printed circuit board; and a lower surface of said radial section spaced away from the printed circuit board after the coaxial electrical is assembled onto the printed circuit board such that there has no material other than air between the lower surface of said radial section and the printed circuit board and no portion of the dielectric block is directly seated upon the printed circuit board under a condition that the whole dielectric block is suspensively supported above the printed circuit board via at least said outer conductor.

2. The electrical connector assembly as claimed in claim 1, wherein said radial section has a concaved lower surface with respect to the lower face of said extension section.

3. The electrical connector assembly as claimed in claim 1, wherein the tubular section has leg sections that extend outwardly from a bottom of the tubular section.

4. The electrical connector assembly as claimed in claim 3, wherein at least one of the leg sections has a curved border.

5. The electrical connector assembly as claimed in claim 4, wherein said at least one leg section has two solder wings with a groove therebetween.

* * * * *